United States Patent [19]

Janson

[11] 4,045,652

[45] Aug. 30, 1977

[54] DEVICE FOR PREVENTING OVERHEATING OF ELECTRIC APPARATUSES

[76] Inventor: Sven-Olof Janson, Svarvaregatan 6, Halmstad, Sweden, 302 50

[21] Appl. No.: 610,084

[22] Filed: Sept. 3, 1975

[30] Foreign Application Priority Data

Sept. 4, 1974 Sweden ..... 7409282

[51] Int. Cl.[2] ..... H05B 1/02; F24H 3/00; F24H 9/20

[52] U.S. Cl. ..... 219/363; 4/160; 219/342; 219/364; 219/367

[58] Field of Search ..... 219/366–371, 219/365, 378, 379, 380, 363, 364, 358, 342; 4/160–164

[56] References Cited

U.S. PATENT DOCUMENTS

| | | | |
|---|---|---|---|
| 2,492,774 | 12/1949 | Wild | 219/364 |
| 2,849,589 | 8/1958 | Lancaster | 219/364 |
| 3,277,274 | 10/1966 | Raabe | 219/370 X |
| 3,348,021 | 10/1967 | Skogland et al. | 219/367 X |
| 3,769,494 | 10/1973 | Janson | 219/364 X |

*Primary Examiner*—A. Bartis

*Attorney, Agent, or Firm*—Holman & Stern

[57] ABSTRACT

An arrangement for preventing overheating in electric air heaters of the type having a plurality of electric heating elements disposed in a casing defining a vertical air flow path having a lower air inlet and an upper air outlet includes the placement of a temperature sensing device in a vertical air channel located adjacent and external to the casing. The vertical air flow channel communicates with the vertical air flow path intermediate the inlet and outlet via an aperture in the casing wall. A flow duct is provided in the casing below the aperture for preventing, during normal operation of the heater, heated air from the interior of the casing from reaching the sensing device in the air channel. If the outlet of the flow path is obstructed, a portion of the hot air well travel from the casing through the aperture to the sensing device to activate the sensing device to deenergize the heating elements.

3 Claims, 4 Drawing Figures

DEVICE FOR PREVENTING OVERHEATING OF ELECTRIC APPARATUSES

BACKGROUND OF THE INVENTION

The present invention relates to a device for preventing overheating of electrical apparatuses, particularly steam bath apparatuses having a casing with a heating device arranged therein, and having lower and upper apertures arranged in the casing to allow air heated by the heating device to flow through the casing. The device comprises a sensing body connected to a control device for the heating device and is arranged to communicate with the interior of the casing through a further aperture in the casing. Flow communication between the interior of the casing and the sensing body through the further aperture takes place when the flow between the lower and the upper apertures in the casing is obstructed, for instance by the upper aperture being covered with a foreign object during heating operation.

Previous device for preventing overheating of steam bath apparatuses are normally used for switching off the apparatus when an unpermissibly high temperature has been reached in the steam bath room.

If an outlet of the apparatus were obstructed and no device for preventing overheating were arranged at the apparatus, it would become overheated and create a risk of the object covering the air channels catching fire.

The same risk is at hand at electric heating radiators, which generally correspond to the steam bath apparatus. Heating coils are also arranged in a casing through which air flows via lower and upper apertures. As in a steam bath apparatus is it essential that the air flow is not disturbed or obstructed. The present invention therefore also refers to such electric apparatuses and to other types of electric apparatus where an unobstructed air flow is of crucial importance for the function of the apparatus.

In Swedish patent specification 346,064 there is shown a device for preventing overheating at steam bath apparatuses, which device in most appliances are prefectly satisfactory. A disadvantage however in certain cases will occur in that the sensing body forming part of the device is subjected to heat radiation from the apparatus. This means that a higher temperature must be set at the thermostat then what should have been required if the heat radiation were eliminated. If said heat radiation could be eliminated is it possible to use a lower thermostat temperature setting and the apparatus would thereby get an absolutely safe function during normal conditions. In consequence herewith is it also essential that the heat radiation is eliminated at electric heating radiators or the like apparatuses.

SUMMARY OF THE INVENTION

It is an object of the invention is therefore to remove said disadvantage at electric apparatuses of the kind mentioned and particularly at electric steam bath apparatuses and electric heating radiators. This object has been achieved by locating the sensor in an air channel communicating with the interior of the casing through an aperture other than the upper and lower apertures. The sensing body is shielded from heat radiation generated by the apparatus by a flow duct arranged in connection with said further aperture which prevents the flow of heated air to the sensing body during unobstructed air flow through the casing.

DESCRIPTION OF THE PREFERRED EMBODIMENT

Figure 1:
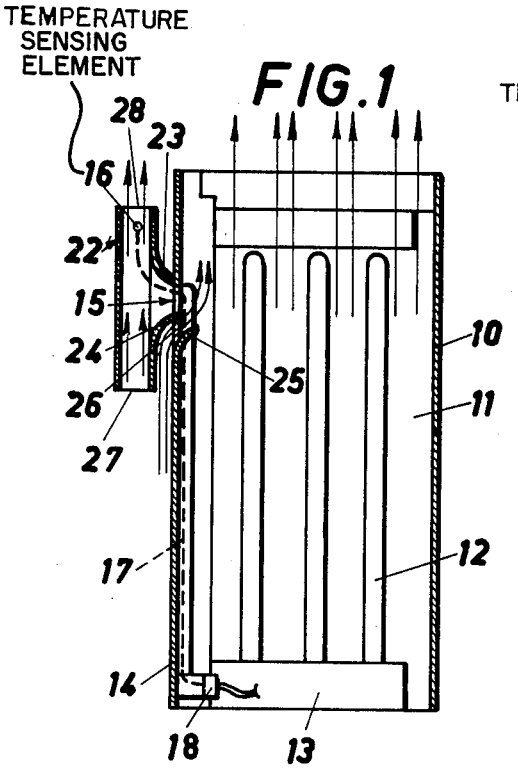
FIG. 1 is a schematic vertical cross section of a steam bath apparatus arranged in accordance with the invention.

The electric steam bath apparatus shown in the drawings is of known design, possibly having a double-mantled sheet metal sheel or casing 10, forming a air chamber 11 open at the upper and lower ends. There is arranged in the air channel electric tube heating radiators 12, for instance one or more for each phase in a three phase net work. The heating radiators are connected to and carried by a connection panel 13, which is controlled by a heat regulator of known type. The heating radiators 12 can extend into a space for heat accumulating bodies, usually stones, which space is arranged in the air chamber 11. As to the arrangement of the air chamber and a possible space for accumulating stones, the apparatus may be made of any of the well known types available on the market. The apparatus is normally errected adjacent to a wall in a steam bath room, by means of brackets or the like, with one wall 14 of the casing 10 facing the steam bath room wall and thus forming the rear wall of the apparatus.

The rear wall 14, which shall be positioned at a safe distance away from the steam bath room wall in order to prevent this wall from being overheated at normal running of the steam bath apparatus, is provided with an aperture 15 in the form of a horizontal slot in the upper part thereof and a short distance from the upper end of the apparatus. In the embodiment shown in tube arrangement 22, having a substantially T-shaped cross section as seen in a direction perpendicular to any of the side walls of the apparatus, is arranged to be sealingly connected together with the upper side 23 of the base portion of the tube of the rear wall 14 at the upper edge of the slot 15. The slot 15 is preferably made so wide that a free space is obtained between the lower side 24 of the base portion of the tube arrangement 22 and the lower edge of the slot 15. A flow plate 25 is preferably arranged as an extension of the rear wall 14 at the lower edge of the slot in order to project obliquely upwards/inwards towards the heaters. For facilitating the flow the plate 25 is preferably bent and the lower surface 24 of the base portion of the tube arrangement 22 is correspondingly bent. Preferably also the surface 23 is curved in order to facilitate the flow from the air chamber or the air channels in the apparatus and out through the tube arrangement 22 when the apparatus is covered.

A sensing body 16, for instance, a tube-formed liquid container is fitted at the upper part of the mainly vertical portion of the tube arrangement 22 shown in FIG. 1. The sensing body 16 extends preferably along the entire length of the slot 15 and may be fitted in the tube arrangement 22 in any appropriate way which doesn't obstruct the flow. The liquid container of the sensing body is connected via a duct 17, forming a capillary tube, to a thermostatic switch 18, which contains a bellows or another expansion means. At a predetermined temperature determined by setting on the thermostatic switch 18, the liquid in the liquid system, which comprises the sensing body 16, the duct 17 and the expansion means of the thermostatic switch 18, has been sufficiently expanded to actuate the thermostatic switch 18.

During normal operation of the apparatus air will flow into the air chamber 11 at the lower aperture rise during heating and leave through the open upper end of the air chamber. Due to injector action, air is sucked in through an aperture 26, defined by the walls or sides 24 and 25. This prevents air flow through the aperture 30, defined by the walls 24 and 23 to the sensing body 16. Air is also entering through the lower, substantially horizontal slot shaped aperture 27 of the tube arrangement 22 and this air passes upwards through the tube arrangement 22 and past the sensing body 16. The air flow has schematically been shown by means of arrows in FIG. 1. The sensing body because of the floor will be shielded off from the heat radiation of the appartus and it will maintain a comparatively low temperature, so that the thermostatic switch 18 can be set accordingly. So set, it will be unactuated at the low temperature, which the sensing body will sense at normal running of the steam bath apparatus. The flow of air past the sensing body and cut through the upper slot-shaped aperture 28 of the tube arrangement 22 makes it possible to achieve the mentioned efficient shielding off from the heat radiation of the apparatus. The thermostatic switch can in a known manner be connected in the electric circuit in series with the heating radiator 12 in order to turn it off when a predetermined higher temperature is reached at the sensing body 16. The thermostatic switch 18 can be included in the deactivating circuit for the circuit supply of the heating radiators.

Figure 2:
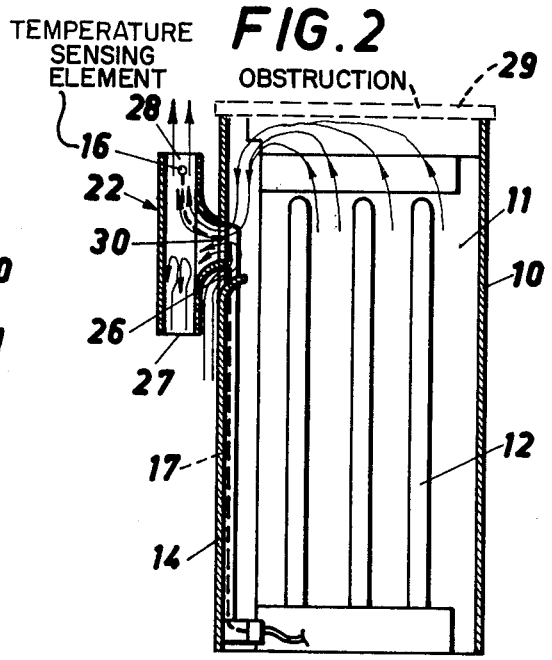
FIG. 2 is a schematic vertical cross section of a type of apparatus similar to that of FIG. 1 and this figure shows the apparatus when it is covered by a foreign object.

If the steam bath apparatus is covered partly or entirely in the manner shown in FIG. 2 by means of a towel or the like, schematically shown in FIG. 2 with reference numeral 29, the air, which has been heated by the heating raditor, will be deflected away from the air chamber by the covering object and the heated air will flow through the base portion of the cross sectionally T-shaped tube arrangement 22, via the aperture 30 in the rear wall 14 such as shown with the arrows in FIG. 2. The heated air will of course continue upwards through the upper, essentially vertical portion of the tube arrangement 22 and will flow past the sensing body 16 and out through the apertures 28. When this warm or hot air flow passes the sensing body 16 the temperature thereof will be highly elevated and as the thermostatic switch is set to be actuated at a relatively low temperature, the heating of the sensing body 16 will immediately cause a disconnection of the current supply of the heating radiators 12. The risk of the steam bath apparatus being overheated to such a high temperature that a fire could start is eliminated.

Figure 3:
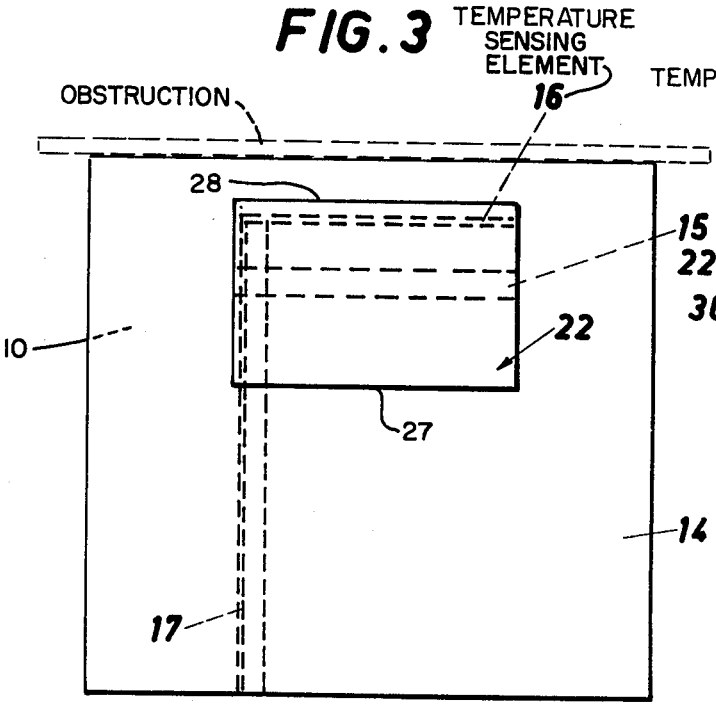
FIG. 3 is a view from the rear side of the steam bath apparatus of FIG. 2.
Figure 4:
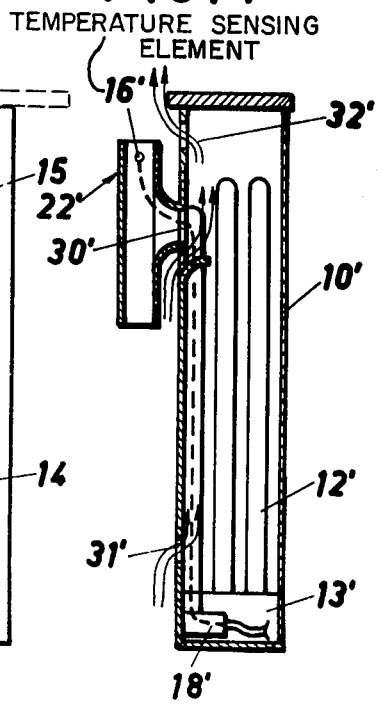
FIG. 4 is a schematic vertical section through an electric heating radiator provided with a device for preventing overheating in accordance with the invention.

In FIG. 4 the device for preventing overheating according to the invention is shown as applied at an electric heating radiator. This heating radiator comprises a casing 10' having heating members 12' located therein, which heating members correspond to with the raditors of the steam bath apparatus in FIG. 1–3 and are controlled from a sensing body 16', via a switch 18' fitted in a connection panel 13'. During normal, unobstructed running, air will flow in through the casing from one or more lower apertures 31' and out through one or more upper apertures 32'. These apertures need not be of the type shown in the drawings but can be shaped and located otherwise. The essential thing is that the apertures are able to allow a suitable air flow through the casing.

If this flow is obstructed thereby that aperture 32' is blocked partly or entirely, the sensing body 16' which is fitted inside a tube arrangemen 22' is adapted to give the same function as that of the steam bath apparatus, i.e. to cut out the current supply to the heating member 12' immediately when hot air is brough through aperture 30' and around the sensing body 16'. In the same manner as with the steam bath apparatus it is possible to maintain a lower and thereby more safe thermostat setting as the heat radiation to the sensing body 16' will be highly reduced.

It is of course to be appreciated that the tube arrangement or the air channel in which the sensing body is located can be designed otherwise than shown in the drawings and described in connection with the particular embodiments. Air intended for shielding the sensing body from the electric apparatus might for instance be introduced around the sensing body otherwise than through the essentially horizontal lower slot of the tube arrangement. A slot or opening in the outer wall of the tube arrangment, which slot or opening extends essentially parallel with the rear wall 14 could be used. It is of coure not necessary that the flow channel for colder air extend through the tube arrangement parallel with the rear side of the apparatus. It is furthermore not necessary that the air flow from the surroundings to the sensing body be brought about via one lower and one upper slot. A plurality of apertures or slots can of course be used with the same result.

For obtaining a maximum actuation speed the tube arrangement with the sensing body therein should preferably be mounted at the upper part of the apparatus. If a certain delay is preferred it is of course possible to mount the sensing body and the tube arrangmenet at a lower level on the rear wall 14.

A sensing body with its tube arrangement can be mounted at the front wall of the apparatus if required. In that case a protecting cap is preferably arranged over the tube arrangement. It is also possible to mount sensing bodies with their tube arrangement at each side of the apparatus.

The invention is thus not limited to the particular embodiments shown on the drawings and specified in connection thereto, and is limited only by the scope of the annexed claims.

What I claim is:

1. An apparatus for preventing overheating of electric heaters wherein said heater includes a casing having a front wall, a rear wall and side walls, a terminal block enclosed in said casing and a number of electric heating elements connected to and supported by said terminal block inside said casing, upper and lower apertures provided in said casing to define an air passage therethrough, said apparatus comprising:

an aperture formed in said casing at a position between said upper and lower openings;

an air channel arranged external to said casing between said upper and lower openings comprising a vertically disposed tube including an intermediate tube perpendicular to said vertically disposed tube, said intermediate tube forming a communication between said vertically disposed tube and said aperture for allowing said air channel to communicate via said aperture with said air passage of said casing;

a sensing body, arranged in said air channel at a position above said aperture, operatively connected to a switch means for controlling a power supply to said heating elements; and a flow duct, provided in said casing immediately below said aperture, for preventing, during normal operation of the electric apparatus, heated air from the interior of said casing from reaching said sensing body in said air channel through said aperture, said aperture and said flow duct being formed by a longitudinal slot in one wall of said casing, said aperture allowing heated air to flow over said sensing body in the event said upper opening is obstructed.

2. The apparatus for preventing overheating as claimed in claim 1, in which the sensing body is fitted at an upper portion of said air channel and essentially parallel to said one wall, the sensing body thereby being positioned at a distance from said one wall.

3. The apparatus for preventing overheating as claimed in claim 1, in which a bent shielding wall is fitted along the lower edge of the slot directed obliquely upwards/inwards and that the base portion of said intermediate tube is provided with a bent surface in order to facilitate the air flow through said flow duct.

* * * * *